US006098368A

United States Patent [19]

McKann

[11] Patent Number: 6,098,368

[45] Date of Patent: Aug. 8, 2000

[54] DOOR WITH REINFORCED METAL PANELS

[75] Inventor: H. Smith McKann, Fredericksburg, Va.

[73] Assignee: Therma-Tru Virginia Company Inc., LLC, Fredericksburg, Va.

[21] Appl. No.: 09/050,081

[22] Filed: Mar. 30, 1998

[51] Int. Cl.[7] ..... F04C 2/34

[52] U.S. Cl. ..... 52/784.13; 52/784.14

[58] Field of Search ..... 52/784.12, 784.13, 52/784.15, 792.1, 792.11, 794.1

[56] References Cited

U.S. PATENT DOCUMENTS

| | | | |
|---|---|---|---|
| 1,796,114 | 3/1931 | Meadowcroft | 52/784.13 |
| 1,848,715 | 3/1932 | Hart et al. | 52/784.13 |
| 2,833,004 | 5/1958 | Johnson et al. | 52/784.13 |
| 3,094,198 | 6/1963 | Haskins | 52/794.1 X |
| 3,153,817 | 10/1964 | Pease, Jr. . | |
| 3,629,046 | 12/1971 | Gilbert . | |
| 3,785,913 | 1/1974 | Hallamore . | |
| 3,786,613 | 1/1974 | Shepheard . | |
| 4,265,067 | 5/1981 | Palmer . | |
| 4,455,801 | 6/1984 | Merritt . | |
| 4,589,240 | 5/1986 | Kendall et al. | 52/784.13 X |
| 4,819,383 | 4/1989 | McKann et al. . | |
| 4,822,657 | 4/1989 | Simpson . | |
| 4,837,999 | 6/1989 | Stayner . | |
| 4,896,458 | 1/1990 | McKann et al. . | |
| 4,973,506 | 11/1990 | Bauer et al. . | |
| 5,366,787 | 11/1994 | Yasui et al. . | |
| 5,569,505 | 10/1996 | Nichols . | |
| 5,570,560 | 11/1996 | Thompson et al. | 52/784.13 |

*Primary Examiner*—Richard Chilcot

*Attorney, Agent, or Firm*—Roylance, Abrams, Berdo & Goodman, L.L.P.

[57] ABSTRACT

A door has two metal panels, with each panel having a rectangular face member with opposite side and end edges. Side and end members extend from the side and end edges and engage to secure the panels together and form the door. Rigid support members are secured to inner surfaces of the face members. A polymer core is located between and engages the support members on its opposite surfaces.

20 Claims, 2 Drawing Sheets

FIG.2
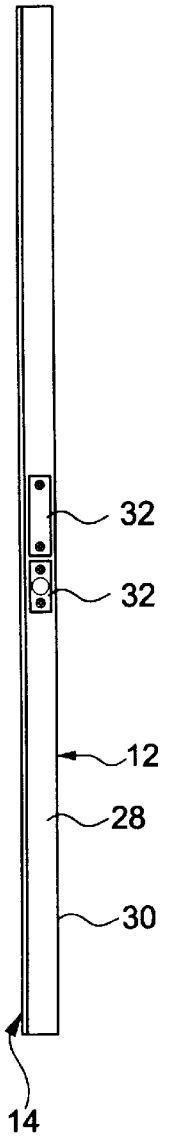
FIG.1
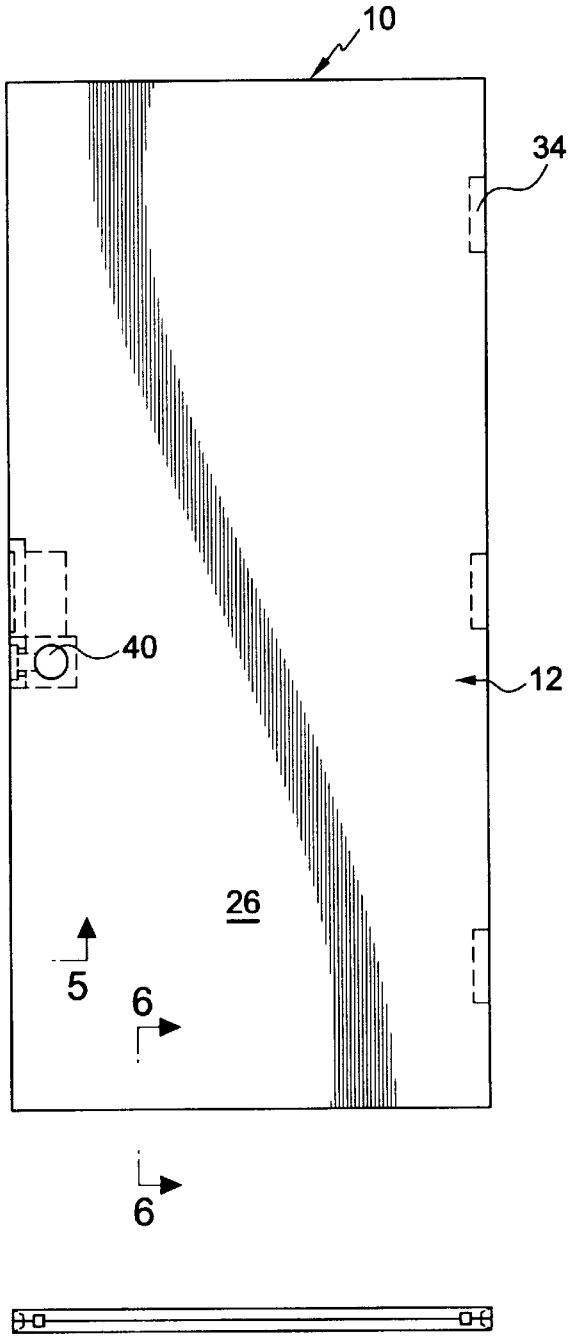
FIG.3
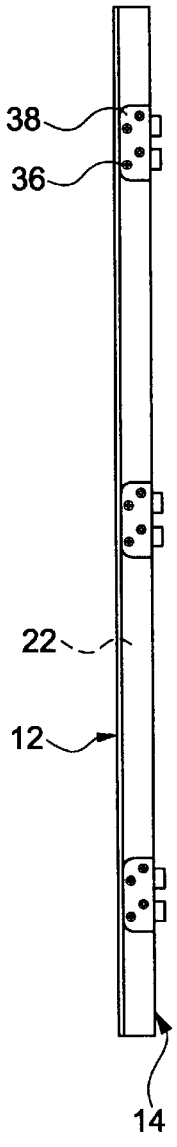
FIG.4

DOOR WITH REINFORCED METAL PANELS

FIELD OF THE INVENTION

The present invention relates to a door having two metal panels which can be secured together to form a door. More particularly, the present invention relates to a metal door having its panels reinforced by rigid support members secured to inner surfaces of the panels, with the support members being separated by a foam core.

BACKGROUND OF THE INVENTION

Steel doors are usually formed with edge parts or channels. The face plates or panel members of the door are secured by fasteners, such as rivets or screws, or by spot welds. By constructing the metal door in this manner, the door must be painted after completing construction to cover the fasteners, welds and other structural parts. Because of the conventional connection of the various parts, pre-coated or pre-painted steel metal cannot be employed.

To avoid these problems and to manufacture a door without the use of fasteners or welding, doors with couplings along the side edges have been proposed. Examples of such doors are disclosed in U.S. Pat. Nos. 4,819,383 and 4,896,458 to McKann et al, the subject matters of which are hereby incorporated by reference.

Since the interior of these doors merely include insulating core members located between the panels, the inner panels can be marred by denting the relatively thin steel material forming the door panels. Thus, the doors need to be reinforced to avoid this denting problem.

SUMMARY OF THE INVENTION

An object of the present invention is to provide a door which can be easily constructed of two metal panels which will resist marring by denting of the relatively thin metal panel material.

Another object of the present invention is to provide a door which can be completely assembled without the use of fasteners or welding.

A further object of the present invention is to provide a door which can be efficiently constructed and easily manufactured, and which is rugged.

The foregoing objects are basically obtained by a door comprising first and second metal panels. Each of the panels has a rectangular face member with opposite side and end edges. Side members and end members extend from the side and end edges, respectively. The respective side and end members of the first and second panels engage to secure the panels together to form the door. First and second rigid support members are secured to inner surfaces of the first and second face panels, respectively. A polymer foam core is located between and engages the first and second support members on opposite surfaces thereof.

By forming the door in this manner, the door is a combination of the metal panels, support members and polymer core. The support members are secured to the inner surfaces of the face members of the panels to prevent denting of the face members. The foam core absorbs the force of blows that would normally dent a metal panel door, with or without a polymer foam core.

The composite door is equal in weight to a solid core wood door, and thus, can be used in residences, hotels, apartments, public housing and military applications. Embossed designs can also be used on the face panels by merely eliminating the support members in the relatively small areas where the embossed pattern is impressed into the metal panels.

Other objects, advantages and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure:

FIG. 1 is a front elevational view of a door according to the present invention;

FIG. 2 is a side elevational view of the door of FIG. 1;

FIG. 3 is a side elevational view of the door of FIG. 1;

FIG. 4 is a bottom plan view of the door of FIG. 1;

DETAILED DESCRIPTION OF THE INVENTION

Figure 5:
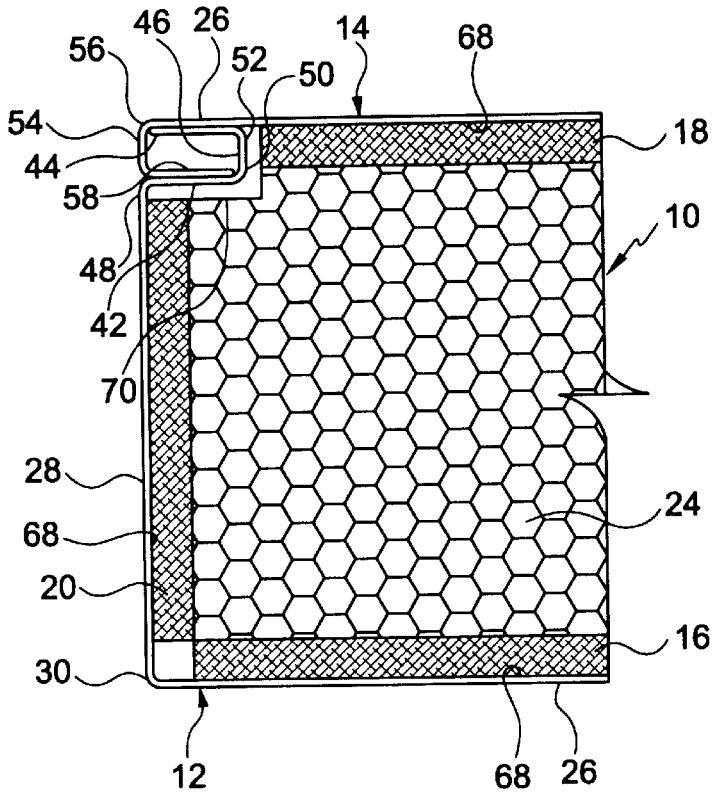
FIG. 5 is an enlarged, partial bottom plan view, in section, taken along line 5—5 of the door of FIG. 1 to illustrate a typical door edge.

The present invention relates to a door 10 which is pivotally mounted along one side edge to a frame and has a latch mechanism and a door knob adjacent its opposite side edge. The door is formed of a latch panel 12 and a hinge panel 14. The two panels are secured together to form the door and to enclose the composite structure of the support members 16, 18, 20 and 22 and the polymer foam core 24.

Each of the panels 12 and 14 is formed of a unitary piece of sheet metal. Each panel has a rectangular, planar face member 26. A side flange or side member 28 extends along the entire length of one of the longer sides of rectangular face member 26 and is connected to face member 26 by a fold line 30. The side flange 28 of edge panel 12 has a latch preparation 32. The side flange of the hinge panel 14 has a hinge preparation 34, including bores for receiving fasteners 36 used to secure hinge plates 38. Additionally, the panels can have knob openings 40.

Each side flange extends substantially perpendicularly from the respective face member from fold line 30 located along a face member side edge, and has a width substantially equal in thickness to that of the door. A coupling is formed along a free lateral edge of each side flange remote from its face member. The side flange coupling comprises a U-shaped fold in the free lateral edge of the side flange. This U-shaped fold opens laterally and outwardly. Each U-shaped fold has an inner leg 42, an outer leg 44 and a center part 46 connecting the two legs. Inner leg 42 extends perpendicularly from the free end edge of side flange 24 from a fold line 48. Center part 46 extends perpendicularly from the end of inner leg 42 remote from side flange 28 along a fold line 50. Outer leg 44 extends perpendicularly from the end of center part 46 remote from the inner leg along a fold line 52.

Another coupling is formed along the side edge of the face member remote from the side flange 28. This other coupling comprises a side member formed by a first flange 54 directly connected to and extending perpendicularly from the respective face member 26 along a fold line 56, and by a second flange 58 extending substantially perpendicularly from the end of first flange 54 remote from the respective face member 26 and parallel to and in the same direction as the respective face member.

The side flange couplings formed by legs 42 and 44 and center part 46 engage the other couplings formed by flanges 54 and 58 to secure the panels together and form the door at diametrically opposite cross-sectional corners of the door. In the coupled condition, each second flange 58 extends into one U-shaped fold of the mating side flange coupling and engages inner leg 42 in a surface to surface contact. Outer leg 44 engages an inner surface of the face member 26 of the other panel adjacent fold line 56.

The top and bottom end edges of each of the two panels 12 and 14 have end members 60 extending perpendicularly from the respective face members 26 along fold lines 62. The inner end of each end member 60 remote from the respective face member 26 has an abutment flange 64 extending perpendicularly from the end member along a fold line 66.

Each of the support members 16, 18, 20 and 22, is relatively thick in comparison to the 22 gauge steel sheet used to form panels 12 and 14. Typically, the support members can be ⅛ inch thick and have peripheral shapes that substantially conform to the face members and side flanges, respectively. The support members can be hardboard or fiberboard made from wood fiber (for example, Masonite). The support members are bonded by an adhesive 68 to the inner surfaces of the face members and side flanges.

Figure 6:
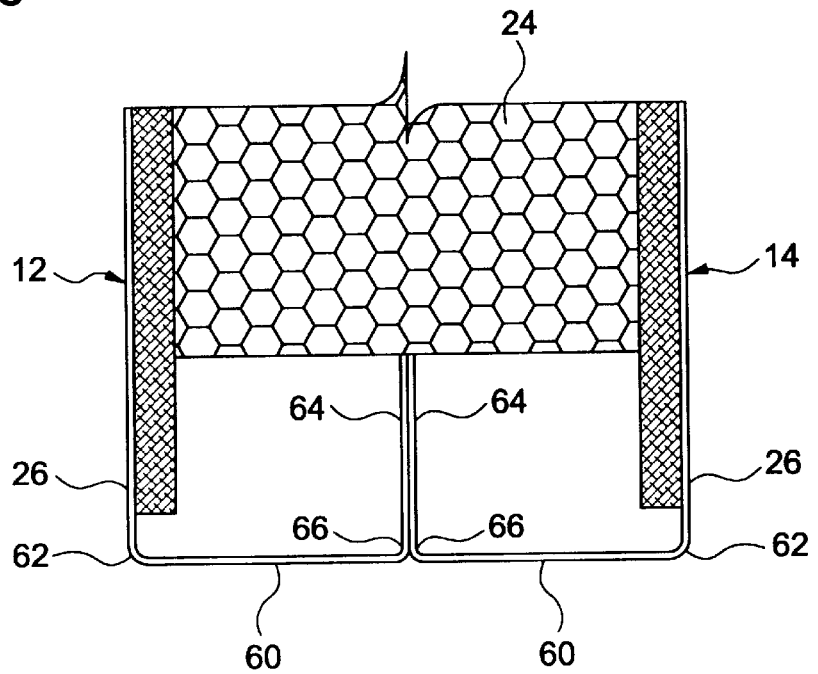
FIG. 6 is an enlarged, partial side elevational, in section, taken along line 6—6 of the door of FIG. 1, illustrating a typical top or bottom of the door.

The support members extend substantially the entire width and height of the face members and side flanges, but stop short of the edges thereof, as illustrated particularly in FIGS. 5 and 6, such that the support member edges do not interfere with each other or with the panel couplings. If design embossments are formed on the face panels, suitable openings can be formed in the support members to accommodate the embossed indentations.

The foam core can be formed of any suitable polymer material which can be injected and formed in place or can be pre-formed and then placed between the panels with the support members adhered to the panels. Diametrically opposite corners of the foam core can be provided with recesses 70 to accommodate the panel couplings.

Although a particular embodiment has been chosen to illustrate the invention, it will be understood by those skilled in the art that various changes and modifications can be made therein without departing from the scope of the invention as defined in the appended claims.

What is claimed is:

1. A door, comprising:

first and second metal panels, each of said panels having a rectangular face member with opposite side and end edges and having side members and end members extending from said side and end edges, respectively, the respective side and end members of said first and second panels engaging to secure said panels together and to form the door;

first and second rigid support members bonded to inner surfaces of said first and second face members, respectively, by adhesive, said first and second support members being relatively thick, wood based sheets substantially conforming to sizes and shapes of said first and second face members, respectively, and substantially extending entire widths and heights of said panels; and a polymer foam core located between and engaging said first and second support members on opposite surfaces thereof.

2. A door according to claim 1 wherein said sheets are approximately ⅛ inch thick.

3. A door according to claim 1 wherein said first and second panels are formed of steel sheets.

4. A door according to claim 1 wherein said first and second panels are formed of 22 gauge steel sheets.

5. A door according to claim 1 wherein said sheets comprise relatively thick sheets of fiberboard made from wood fiber.

6. A door, comprising:

first and second panels, each of said panels being formed of a unitary piece of sheet metal and including a a rectangular face member with opposite side and end edges and with inner and outer surfaces, a side flange extending substantially perpendicularly from said face member along one of said side edges, said side flange having a width substantially equal to a thickness of the door, a first coupling formed along free lateral edge of said side flange remote from said face member, a second coupling formed along the outer side edge of said face member, and end flanges extending substantially perpendicularly from said face member along said end edges;

said first and second couplings of said first panel engaging said second and first couplings, respectively, of said second panel to secure said panels and form the door, said couplings being located at diametrically opposite corners of the doors;

first and second rigid, relatively thick, wood based support sheets bonded to said inner surfaces of said face members of said first and second panels, respectively, by adhesive, said sheets substantially confirming to sizes and shapes of said face members of said first and second panels, respectively, to extend substantially entire widths and heights thereof; and a polymer foam core engaging and located between said support sheets.

7. A door according to claim 6 wherein each said second coupling comprises a first flange directly connected to the respective face member other side edge along a fold line and extending substantially perpendicularly relative to the respective face member, and a second flange extending substantially perpendicularly from an end of said first flange remote from the respective face member and parallel to and in the same direction as the respective face member.

8. A door according to claim 6 wherein each said first coupling comprises a laterally outwardly opening U-shaped fold in the free lateral edge of each said side flange, with each said U-shaped fold having inner and outer legs connected by a center part.

9. A door according to claim 8 wherein each said second coupling comprises a first flange directly connected to the respective face member other side edge along a fold line, extending substantially perpendicularly relative to the respective face member, and a second flange extending substantially perpendicularly from an end of said first flange remote from the respective face member and into said U-shaped fold and overlying said inner leg of the respective U-shaped fold; and said outer legs engage said inner surface of said face members.

10. A door according to claim 6 wherein said sheets are approximately ⅛ inch thick.

11. A door according to claim 6 wherein said first and second panels are formed of steel sheets.

12. A door according to claim 6 wherein said first and second panels are formed of 22 gauge steel sheets.

13. A door according to claim 6 wherein said first and second support sheets comprise fiberboard made from wood fiber.

14. A door according to claim 6 wherein rigid support members are secured to inner surfaces of said side flanges.

15. A door according to claim 1 wherein said sheets comprise hardwood.

16. A door according to claim 6 wherein said sheets comprised hardwood.

17. A door according to claim 1 wherein a rigid, relatively thick, wood based support sheet is bonded to an inner surface of each of said side members by adhesive.

18. A door according to claim 14 wherein said support members comprise relatively thick, wood based sheets.

19. A door according to claim 1 wherein said support members are bonded to said core.

20. A door according to claim 6 wherein said support sheets are bonded to said core.

* * * * *